US005108664A

United States Patent [19]

Pedersen

[11] Patent Number: 5,108,664

[45] Date of Patent: Apr. 28, 1992

[54] CARBURETOR METERING SYSTEMS

[76] Inventor: John R. C. Pedersen, 3 Priors Road, Cheltenham, England

[21] Appl. No.: 435,405

[22] PCT Filed: Mar. 2, 1989

[86] PCT No.: PCT/GB89/00216

§ 371 Date: Nov. 1, 1989

§ 102(e) Date: Nov. 1, 1989

[87] PCT Pub. No.: WO89/08184

PCT Pub. Date: Sep. 8, 1989

[30] Foreign Application Priority Data

Mar. 2, 1988 [GB] United Kingdom ..... 8804952

[51] Int. Cl.[5] ..... F02M 7/14

[52] U.S. Cl. ..... 261/44.5; 261/50.2; 261/DIG. 38

[58] Field of Search ..... 261/44.5, 50.2, DIG. 38

[56] References Cited

U.S. PATENT DOCUMENTS

| | | | |
|---|---|---|---|
| 1,535,860 | 4/1925 | Royce | 261/49 |
| 3,166,292 | 1/1965 | Forman | 261/DIG. 38 |
| 3,342,463 | 9/1967 | Date et al. | 261/50.2 |
| 3,469,825 | 9/1969 | DuBois | 261/DIG. 38 |
| 4,123,233 | 10/1978 | Mannino | 261/64.4 |
| 4,152,375 | 5/1979 | Muller et al. | 261/50.2 |
| 4,349,489 | 9/1982 | Gaget et al. | 261/DIG. 38 |
| 4,434,110 | 2/1984 | Highfield | 261/44.5 |

FOREIGN PATENT DOCUMENTS

| | | | |
|---|---|---|---|
| 678694 | 4/1930 | France . | |
| 1450632 | 7/1966 | France . | |
| 2415743 | 9/1979 | France | 261/DIG. 38 |
| 508215 | 6/1939 | United Kingdom . | |

*Primary Examiner*—Tim Miles
*Attorney, Agent, or Firm*—John P. White

[57] ABSTRACT

A fuel valve 1 is provided for injecting liquid fuel into a stream of air which comprises a valve member 2 movable along a displacement axis 3 with respect to a valve seat 4 to vary the fuel flow through the valve 1. The valve member 2 and the valve seat 4 have substantially parallel surfaces 7 and 9 which are inclined with respect to the displacement axis 3 and which define therebetween a passage for the flow of fuel having a width W corresponding to the distance apart of the surfaces 7 and 9 and a length L corresponding to the degree of overlap of the surfaces 7 and 9. The length L of the passage varies substantially in proportion to the width W as the valve member 2 is moved along the displacement axis 3. Such a valve construction minimizes the effect of momentum changes in the fuel orifice, and enables accurate control of fuel flow over a wide range of air flows and mixture strengths.

10 Claims, 1 Drawing Sheet

CARBURETOR METERING SYSTEMS

This invention relates to carburetor metering systems for supplying a fuel/air mixture.

It is known that substantial advantages are to be obtained, in terms of part load fuel economy and decrease of exhaust pollution, by operating a spark ignition engine with a fuel/air mixture having excess air over that required for just complete combustion of the fuel, that is with a lean mixture of fuel in air. Conventionally engines can readily tolerate excess fuel in the fuel/air mixture to a considerable degree. However, lean mixture operation requires precise control of mixture strength to ensure reliable operation without misfiring. Thus conventional carburetor system are generally unsuitable for supplying engines operating at lean mixture strengths.

A carburetor system suitable for supplying lean mixtures of fuel in air is disclosed in applicant's British Patent Specification No. 1,595,315 and corresponding U.S. Pat. No. 4,290,401. This carburetor comprises an evaporator for evaporating the fuel into a stream of air and a closed-loop control arrangement for maintaining the mixture strength at a required value in dependence on the temperature drop measured across the evaporator. Whilst such a carburetor is capable of operating adequately in a lean burn system, it has a fairly slow response time, set by the response time of the thermometric sensors, which can render the engine sluggish in operation. Robust, inexpensive thermometric sensors have response times of several seconds. More rapidly responding sensors are frail and expensive.

It is an object of the invention to provide a carburetor metering system capable of accurately controlling fuel flow over a wide range of air flows and mixture strengths.

According to the present invention, there is provided a carburetor metering system comprising a fuel valve for injecting liquid fuel into a stream of air, the valve comprising a valve member movable along a displacement axis with respect to a valve seat to vary the fuel flow through the valve, the valve member and the valve seat having substantially parallel surfaces which are inclined with respect to the displacement axis and which define therebetween a passage for the flow of fuel having a width corresponding to the distance apart of the surfaces and a length corresponding to the degree of overlap of the surfaces, the length of the passage varying substantially in proportion to the width as the valve member is moved along the displacement axis.

The system of the invention has been developed after detailed study of the mechanisms which affect fuel flow rates in conventional carburetors. As is well known, a pressure difference induced by the air flow is generally used to drive fuel through the metering orifice, and the fuel flow rate is caused to vary in dependence on the air flow rate. However, the fuel flow rate tends to vary unpredictably with air flow rate due to the fact that there are two different mechanisms which determine the relevant pressure differentials, one of which arises from the viscosity of the fluid and the other of which is dependent on momentum changes of the fluid. The relative magnitude of the two mechanisms varies with temperature and pressure, as well as with fluid flow and the proportions of the flow passage. Furthermore the relative magnitude of the two mechanisms is different for fuel and air in view of the different volume flow rates of fuel and air. The system of the invention is chosen so as to minimise the effects of momentum changes in the fuel orifice.

In a development of the invention the system further comprises an air control valve for adjusting the valve member to vary the fuel flow through the fuel valve on dependence on the air flow. Preferably the geometry of the air control valve is chosen such that the effect of the viscosity of the air on the pressure difference across the valve is negligible. Furthermore the relative geometries of the throughflow orifice of the fuel valve and the air control valve are preferably such that, with a constant pressure difference across the air control valve, the mixture strength is substantially independent of flow over a wide range of air flows.

Generally the pressure difference across the fuel valve is in proportion to (commonly, but not necessarily, equal to) the pressure difference across the air control valve, both these pressure differences being substantially independent of flow when conditions are steady (or, more accurately, when conditions are fluctuating about a constant mean).

The air control valve conveniently comprises a seat member and a gate member cooperating to define at least one orifice, the gate member being movable with respect to the seat member to vary the throughflow cross-section of the or each orifice, and the total throughflow cross-section of said at least one orifice being proportional to the square of the displacement of the gate member from the closed position.

The fuel valve conveniently has a circular orifice within which a tapered end of the valve member is movable, the fuel passage being defined between a frustoconical surface of the tapered end of the valve member and a surrounding frustoconical surface of the valve seat.

Furthermore it is advantageous for the valve seat to have a cylindrical surface which lies immediately upstream of its frustoconical surface and which merges steplessly into its frustoconical surface so as to minimise the momentum effect.

In addition it is advantageous for the valve member to have a cylindrical surface which lies immediately downstream of its frustoconical surface and which merges steplessly into its frustoconical surface.

In order that the invention may be more fully understood, a preferred form of carburetor metering system in accordance with the invention will now be described, by way of example, with reference to the accompanying drawing, in which.

Figure 1:
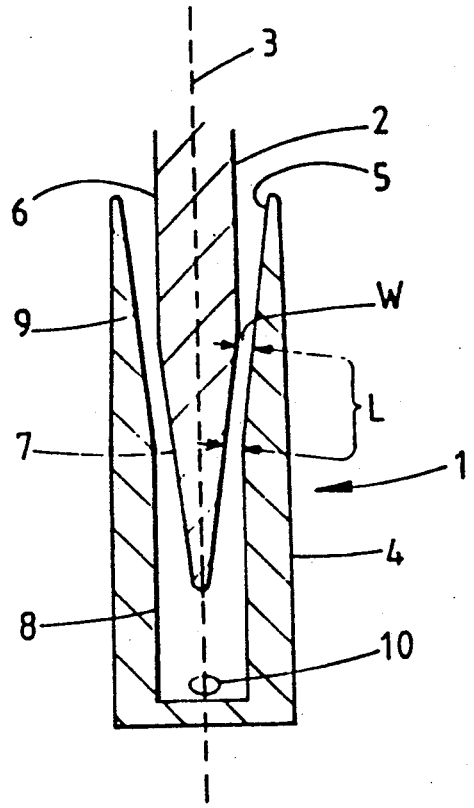
FIG. 1 is an axial section through a fuel valve of the system.

Referring to FIG. 1, the fuel valve 1 comprises a needle valve member 2 movable along a displacement axis 3 with respect to a valve seat 4. The valve 1 has a circular orifice 5 by way of which liquid fuel is injected into a stream of air. The valve member 2 has an outer cylinderical surface 6 and a tapered end defining a frustoconical surface 7. The valve seat 4 has an inner cylindrical surface 8 and a frustoconical surface 9 surrounding the frustoconical surface 7 of the valve member. 2. The valve seat 4 is provided with a fuel inlet 10.

The conical angle of the frustoconical surface 7 matches the conical angle of the frustoconical surface 9, and the two surfaces 7 and 9 overlap one another so as to define therebetween an annular passage for the flow of fuel. It will be appreciated that the length of overlap L of the surfaces 7 and 9 will vary substantially in proportion to the width W of the passage as the valve member 2 is moved along the displacement axis 3 with respect to the valve seat 4. Thus the fuel flow through the orifice 5 for a given pressure difference is proportional to the square of the width W which is in turn proportional to the degree to which the valve member 2 is lifted.

Figure 2:
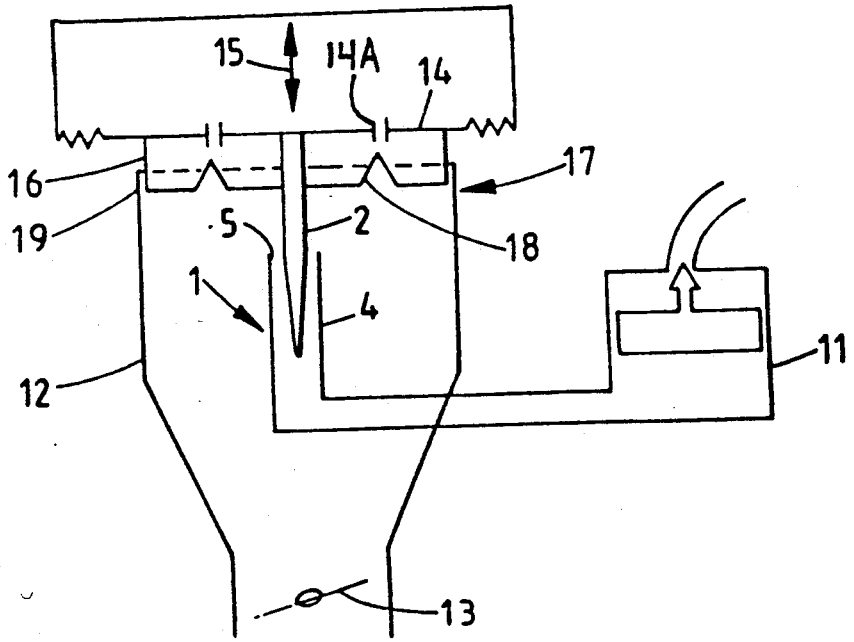
FIG. 2 is a schematic diagram of the system.

FIG. 2 shows the fuel valve 1 connected to a conventional float chamber 11 for supplying liquid fuel to the valve 1. The fuel orifice 5 opens into an air duct 12 provided with a throttle 13. The valve member 2 is connected to a movable diaphragm 14 having orifices 14A therein and capable of being deflected in the direction of the arrows 15 to move the valve member 2 with respect to the valve seat 4 so as to vary the fuel flow through the valve 1. Also connected to the diaphragm 14 is a gate member 16 of an air control valve 17 enabling adjustment of the valve member 2 with respect to the valve seat 4 in dependence on the air flow. The gate member 16 has a cylindrical wall having a plurality of triangular cut-outs 18 along its edge. Furthermnore the gate member 16 fits within the cylindrical end of the duct 12 which defines a seat member 19 of the air control valve 17.

It will be appreciated that, as the diaphragm 14 is deflected in the direction of the arrows 15 by the pressure difference across the air control valve 17, the gate member 16 will be moved within the seat member 19 so as the vary the throughflow cross-section of the triangular cut-outs 18. Thus the throughflow cross-section of the air control valve 17 varies in porportion to the square of the degree of deflection of the diaphragm 14, and hence the degree of displacement of the valve member 2.

The geometries of displacement of the orifices of the fuel valve 1 and the air control valve 17 are chosen so as to ensure that, with a constant presure difference across the air control valve, the mixture strength is independent of flow over a range limited only by manufacturing inaccuracy, and so that adjustment of the pressure difference can be used to adjust the mixture strength.

With this arrangment the mixture strength is proportional to the square root of the pressure difference. If required the mixture strength can be adjusted by arranging for only an adjustable fraction of the whole pressure difference across the air control valve 17 to be used to lift the gate member 16 against its dead weight or a return spring. Typically it is necessary to adjust the pressure difference to provide variable mixture strength and compensate for changes in fuel viscosity and air density.

It will be appreciated that the particular geometries of the valve member 2 and the valve seat 4 of the fuel valve 1 are advantageous because they ensure that pressure differences related to the viscosity of the fuel are substantially greater than pressure differences due to momentum changes of the fuel, and since the essential geometry of the fuel passage is maintained as the throughflow cross-section is varied.

The described carburetor metering system is capable of accurately controlling the fuel flow over a wide range of air flows and mixture strengths, and is therefore particularly applicable to lean mixture operation. The system typically has a response time of the order of a tenth of a second.

I claim:

1. A carburetor metering system comprising a fuel value for injecting liquid fuel into a stream of air, the valve comprising a value member movable along a displacement axis with respect to a valve seat to vary the fuel flow through the valve between two limiting positions, namely a substantially closed position and a fully open position, the valve member and the valve seat having substantially parallel surfaces which are inclined with respect to the axis and which define therebetween a passage for the flow of fuel having a width corresponding to the distance apart of the surface and a length corresponding to the degree of overlap of the surface, the form of said surfaces being such that, as the valve member is moved along the displacement axis from its substantially closed position, wherein there is substantially no overlap of the surfaces, towards its fully open position, the length and the width of the passage increase substantially proportionally from values of substantially zero.

2. A system according to claim 1, further comprising means for producing a mixture strength substantially independent of flow over a wide range of air flows when a constant pressure difference exists across the air control valve.

3. A system according to claim 1, wherein the valve member of the fuel valve is connected to a movable diaphragm means for moving the valve member along the displacement axis with respect to the valve seat.

4. A system according to claim 1, further comprising an air control valve means for controlling the air flow and operatively connected to the valve member to vary the fuel through the fuel valve, in dependence on the air flow.

5. A system according to claim 4, wherein the air control valve means comprises a seat member and a gate member cooperating to define at least one orifice, the gate member being movable with respect to the seat member to vary the throughflow cross-section of the orifice, and the total throughflow cross-section of said orifice being proportional to the square of the displacement of the gate member from a closed position.

6. A system according to claim 4, wherein the air control valve means comprises a seat member and a gate member cooperating to define at least one orifice, the gate member being movable with respect to the seat member to vary the throughflow cross-section of the orifice to control the air flow such that the effect of the viscosity of the air on the pressure differecne across the valve is negligible.

7. A system according to claim 1, wherein the valve member has a tapered end with a frustoconical surface and the fuel valve has a circular orifice within which the tapered end of the valve member is moveable, and wherein the valve seat has a frustoconical surface, the fuel passage being defined between the frustoconical surface of the taperred end of the valve member and the surrounding frustoconical surface of the valve seat.

8. A system according to claim 7, wherein the valve member has a cylindrical surface which lies immediately downstream of its frustoconical surface and which merges steplessly into its frustoconical surface.

9. A system according to claim 7, wherein the conical angle of the frustoconical surface of the valve seat matches substantially the conical angle of the frustoconical surface of the valve member.

10. A system according to claim 7, wherein the valve seat has a cylindrical surface which lies immediately upstream of its frustoconical surface, said cylindrical surface merging steplessly into its frustoconical surface.

* * * * *